United States Patent [19]

Centeno

[11] Patent Number: 4,570,415

[45] Date of Patent: Feb. 18, 1986

[54] VEGETABLE BANDING APPARATUS

[75] Inventor: Edward M. Centeno, Salinas, Calif.

[73] Assignee: Mann Packing Co., Inc., Salinas, Calif.

[21] Appl. No.: 620,274

[22] Filed: Jun. 13, 1984

[51] Int. Cl.[4] ..... B65B 13/24

[52] U.S. Cl. ..... 53/399; 53/390; 53/435; 53/515; 53/583; 99/639; 83/925 EB

[58] Field of Search ..... 53/292, 296, 390, 399, 53/435, 441, 515, 556, 583, 585; 83/277, 925 EB; 99/639; 100/2, 9

[56] References Cited

U.S. PATENT DOCUMENTS

| | | | |
|---|---|---|---|
| 2,787,104 | 4/1957 | Carter | 53/292 |
| 3,667,331 | 6/1972 | Regec et al. | 83/277 |
| 3,888,067 | 6/1975 | Cross et al. | 53/292 |
| 4,041,672 | 8/1977 | Gularte | 53/399 |
| 4,149,357 | 8/1979 | Lucke | 53/585 |
| 4,401,020 | 8/1983 | Brux | 53/390 |
| 4,442,765 | 4/1984 | Limehouse et al. | 53/556 |
| 4,470,241 | 9/1984 | Parry et al. | 53/556 |
| 4,480,536 | 11/1984 | Burns | 53/585 |

*Primary Examiner*—James F. Coan
*Attorney, Agent, or Firm*—Gerald L. Moore

[57] ABSTRACT

An apparatus for placing an elastic band (22A) around a vegetable bunch (19) comprising a band stretcher assembly (26) for receiving the band, a plurality of fingers (46) for stretching the band, and means (37) for moving the band stretcher towards a top plate assembly 21 along a central axis. The band is placed on the band stretcher fingers and stretched, the vegetable bunch is placed through the openings (20) and (50) and the band relaxed therearound. The band stretcher is then moved from the top plate assembly to disengage said fingers from said band. Thereafter the plate sections (54) and (55) are pivoted to enlarge the opening (20) and allow the banded vegetable bunch to drop from the apparatus.

11 Claims, 18 Drawing Figures

VEGETABLE BANDING APPARATUS

FIELD OF THE INVENTION

Apparatus for placing elastic bands around bunches of vegetables.

BACKGROUND OF THE INVENTION

Many vegetables such as broccoli, celery, carrots, and the like are now marketed in bunches. Originally the bunches were held together by wire ties, plastic bags, plastic rings or other means. The vegetables are bunched by hand and it is difficult, expensive, and time consuming to place such a tie around the bunch.

Lately there has been devised a bander which receives an elastic band on outstretched fingers held by pivotable arms grouped around an axis. Thereafter these arms are actuated to pivot the ends away from each other and stretch the elastic band so the vegetable bunch can be inserted therein. With relaxing of the arms the band is set around the bunch and thereafter the bunch is pulled in the axial direction from the bander which releases the band from the fingers so that it stays on the vegetables.

It is one object of the present invention to provide for automatically loading the bands on such a bander. It is a further object of the present invention to provide for the automatic release of the vegetable bunch from the machine after banding is completed.

SUMMARY OF THE INVENTION

Apparatus for placing elastic bands on articles such as vegetables comprising a band stretcher having a plurality of arms pivotally attached to a frame and with extending fingers which move towards and away from a central axis in unison. A top plate comprised of two sections forms a center opening for guiding the vegetables along the central axis and into the stretched elastic band. An automatic loader receives the elastic material in tube form, cuts individual bands therefrom, and spreads the band while shifting it onto the fingers of the band stretcher. The vegetables are placed through the top plate center opening after the elastic band is stretched, the arms are relaxed to set the band on the vegetables and thereafter the band stretcher is shifted axially along the bunch to disengage the fingers and leave the band on the vegetables. The top plate is then opened to allow the banded bunch to fall from the apparatus.

DESCRIPTION OF THE INVENTION

Figure 2:
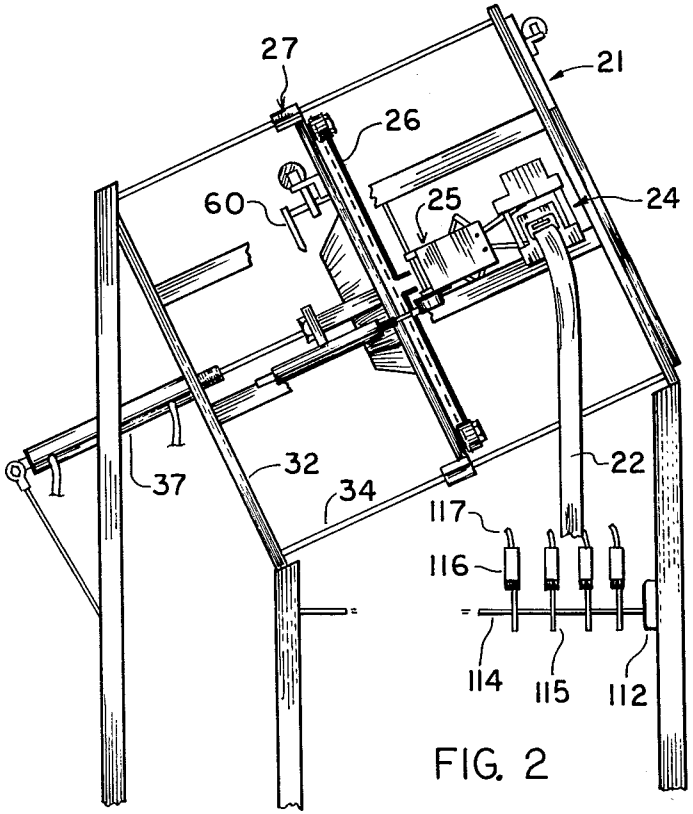
FIG. 2 is a side view in the direction of line 2—2 of FIG. 1.
Figure 1:
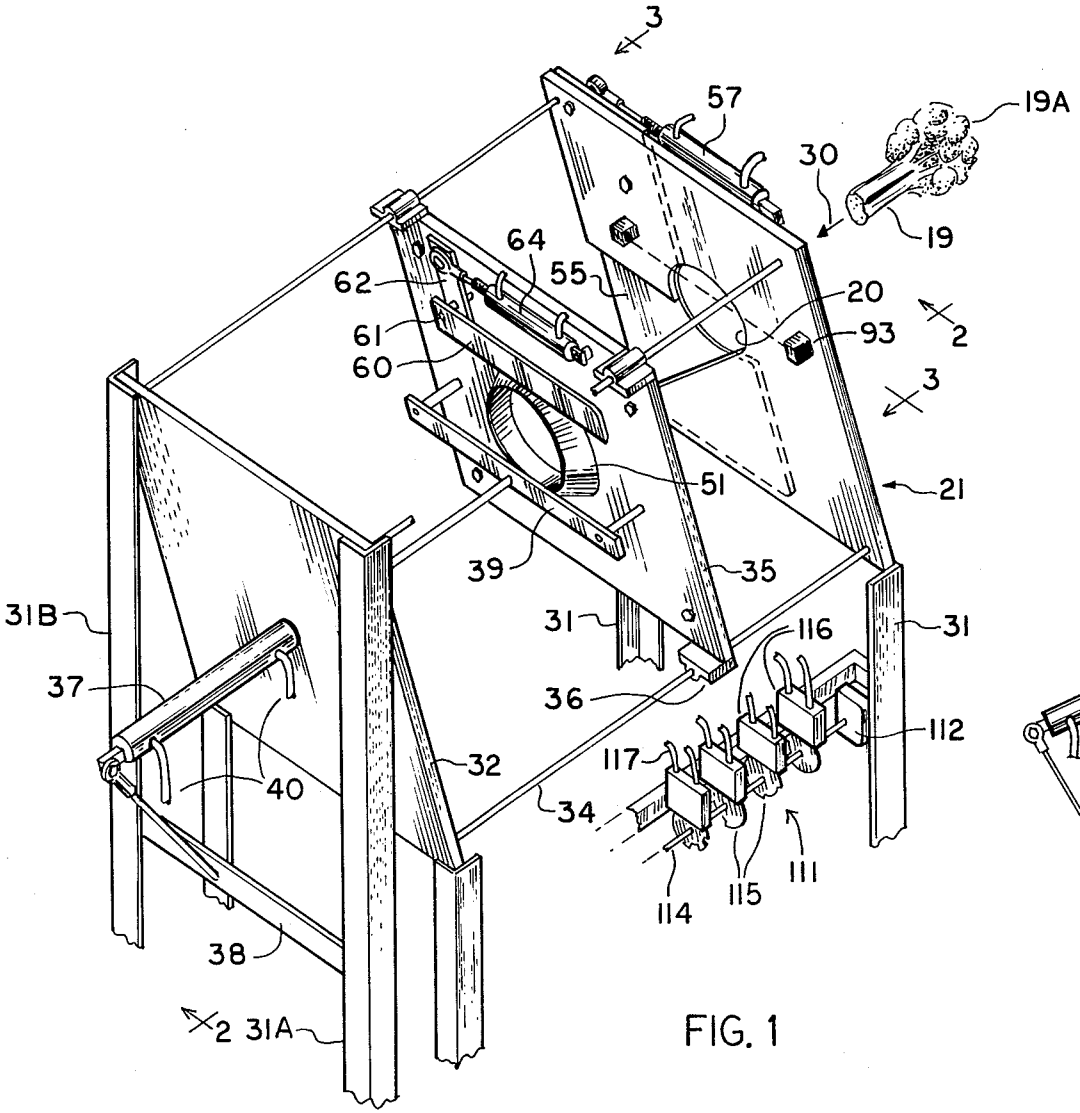
FIG. 1 is a perspective view of the apparatus incorporating the subject invention.

In FIGS. 1 and 2 is shown a banding apparatus incorporating the subject invention. The vegetable to be banded is fed in the form of a bundle 19 through a center opening 20 in a top plate assembly 21. Elastic tubing 22 is fed to a band cutter 24 and severed into individual bands 22A for transference to the band stretcher 26 by a transfer device 25. The band stretcher 26 receives the band and stretches it while being shifted to the position adjacent the top plate assembly 21 for receiving the bundle to be banded.

After insertion of the bundle 19, the band spreader is relaxed to set the elastic band. Thereafter the carrier is actuated to transfer the spreader to the lower position for disengagement of the bundle from the elastic band. The top plate assembly is then opened to allow the banded vegetable bunch to drop from the apparatus.

Figure 3:
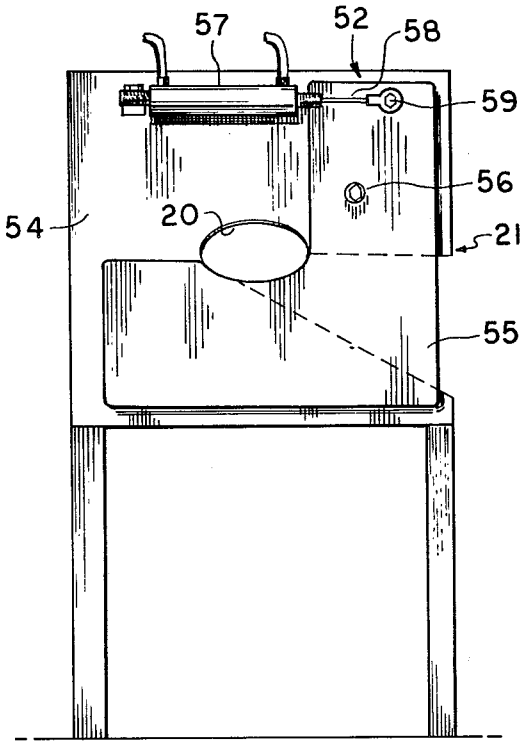
FIG. 3 is a view along the line 3—3 of FIG. 1.
Figure 5:
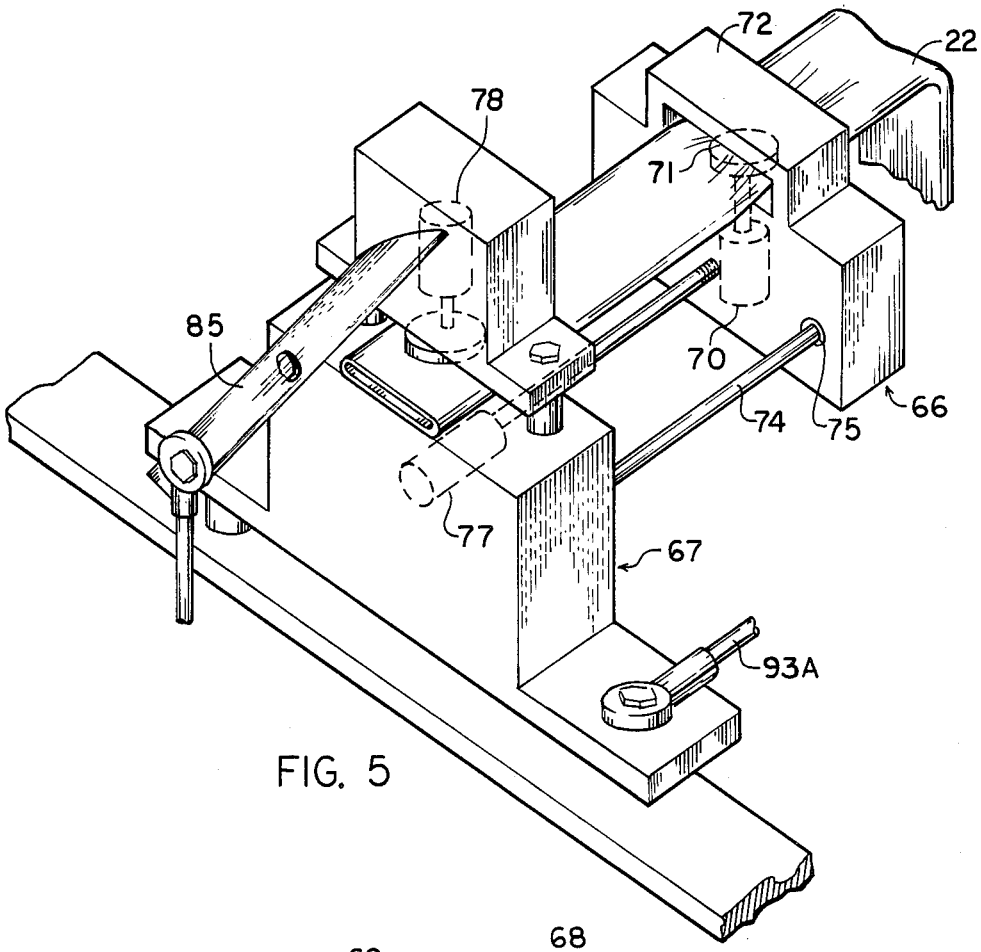
Figure 6:
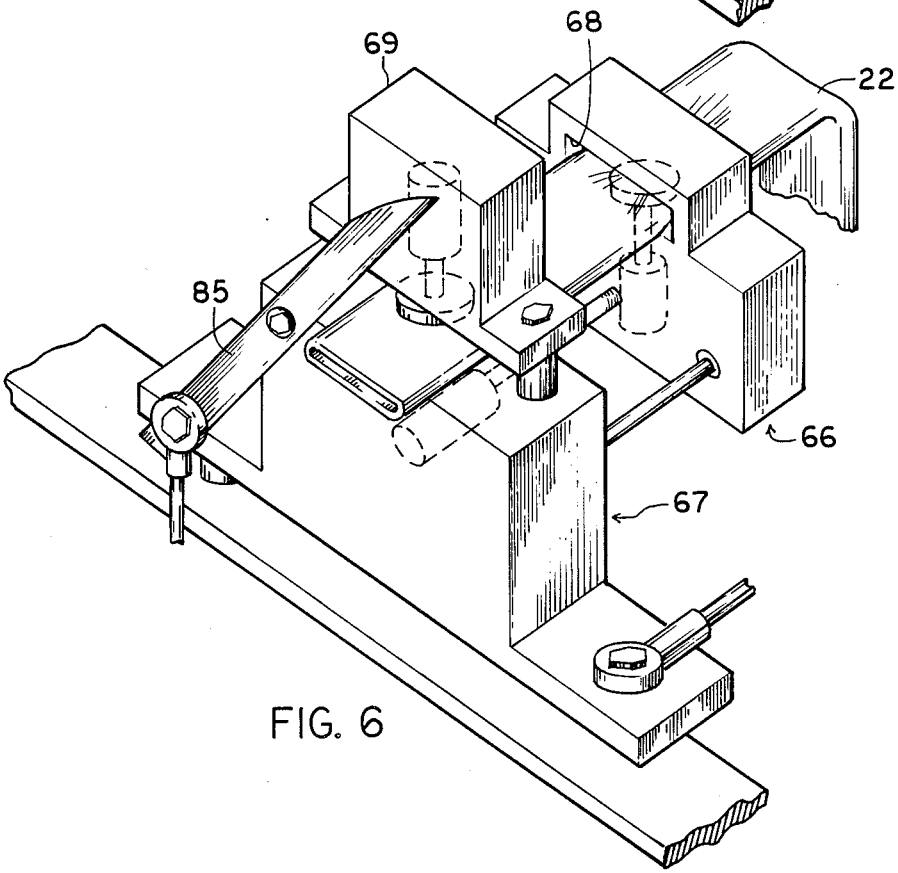
Figure 7:
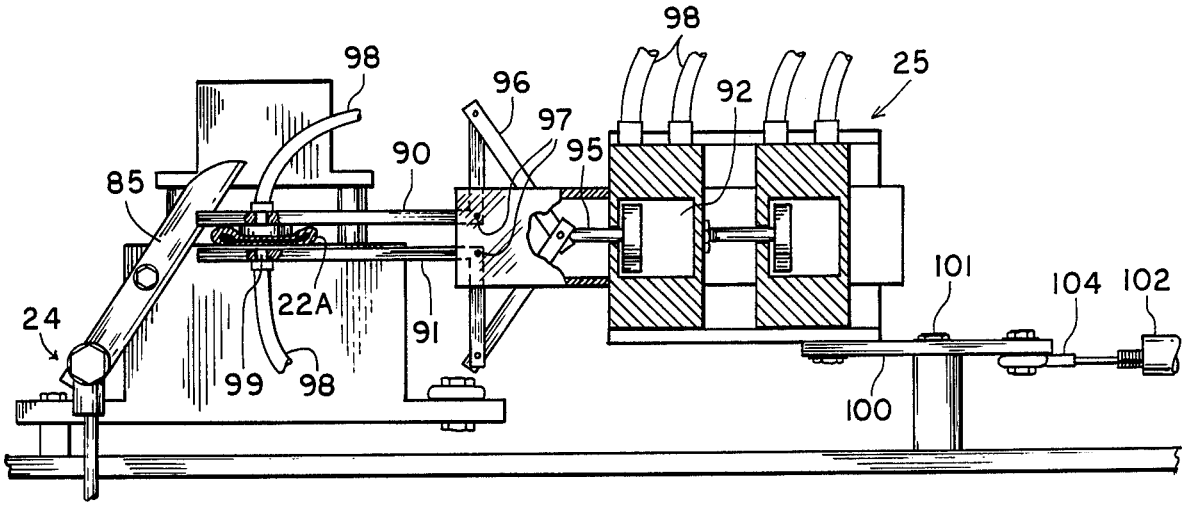
FIG. 7 shows the band transfer mechanism.

To explain the apparatus in detail, the top plate assembly 21 is supported at an angle from the horizontal, as shown in FIGS. 1, 2, and 3, primarily for the convenience of the person loading the vegetable bunch 19 into the apparatus. The vegetable bunch is loaded through the center opening 20 along a central axis 30. The top plate assembly is supported on legs 31 extending to the floor. Connecting the top plate assembly and a bottom plate 32 are a plurality of rods 34. Supported on these rods is the band stretcher 26 comprising a bander plate 35 fixed to guides 36 which ride longitudinally along the rods 34 and thus allow this assembly to be moved towards and away from the top plate assembly. For actuation of this bander plate, an air cylinder 37 is fixed at one end to a cross piece 38 extending between the legs 31A and 31B at the base of the apparatus. The actuating shaft 38 of the air cylinder extends upward to a mount 39 fixed to the bander plate. By providing pressured air through the selected tube 40 of the air cylinder the bander plate can be caused to be moved towards and away from the top plate assembly.

Figure 10:
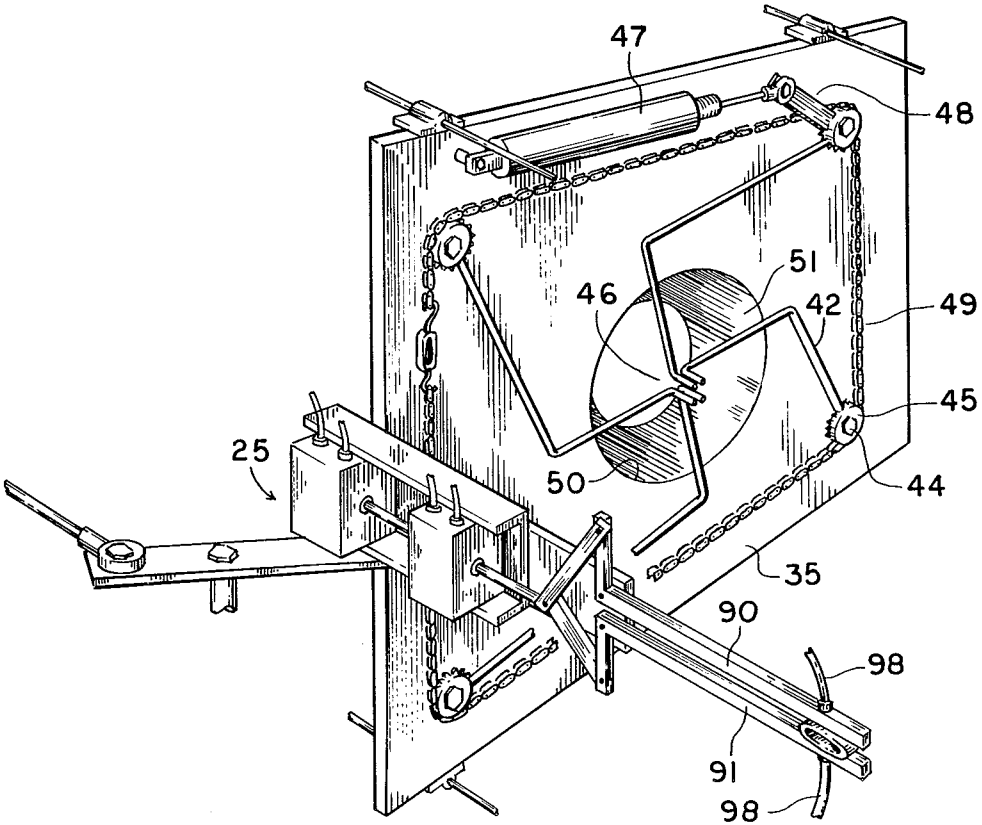
FIG. 10 shows the transfer mechanism for the elastic band.

As shown primarily in FIGS. 1 and 10, the band stretcher 26 or banding means comprises a plurality of arms 42 each pivotally attached to the bander plate 35 by a bolt 44. Fixed to each arm is a sprocket 45 with each arm being positioned at one of the four corners of the plate. The arms support extending fingers 46 such that by rotation of the sprocket, the attached arm moves radially outward from the axis 30. To actuate the arm there is an air actuator 47 having an actuating arm 48 attached to one of the sprockets. Extending around the sprockets is a chain 49 such that rotation of one sprocket causes rotation of all sprockets. Thus, when the actuator is energized by pressured air from a supply (not shown) the attached sprocket is rotated, the chain is rotated around all of the sprockets, and all of the arms are actuated in unison.

Thus, operation of the device occurs by placement of a rubber band over the upward extending fingers 46, energization of the actuator 47 to stretch the band about the center hole 50, and movement of the band stretcher 26 to the upward position adjacent the top plate assembly 21. When in this position the vegetable bunch 19 can be placed through the hole 20 and the aligning hole 50 with a truncated cone 51 tending to compress the bunch. Thereafter by release of the actuator 47 the band is allowed to set about the bunch. Subsequent actuation of the bander plate 35 in the direction away from the top plate causes the fingers 46 to release from the band since the vegetable bunch is held by the larger diameter head 19A not passing through the top plate opening 20. In this manner the bunch is banded and thereafter separated from the bander.

To release the bunch from the device the top plate 52 is made of the sections 54 and 55. These sections are pivotally connected by a bolt 56 such that with the energization of an air actuator 57, the actuating arm 58 connected to the extending end of the plate section 55 by a bolt 59 pivots that section about the bolt 56 to open the top opening 20 thereby allowing the bunch to fall from the top plate. The actuator is actually a dual direction actuator which serves first to move the plate section 55 to close the opening 20 partially and hold the vegetables in place while being banded, and to thereafter open the side of the opening to allow the banded bunch to fall from the apparatus as previously described.

In accordance with another feature of the present invention, provisions are made for cutting off the bottom of the bunch to a uniform length. For this purpose there is fixed to the bottom side of the bander plate 35 a knife blade 60 pivotally supported on a bolt 61 and with an attached arm 62 extending at right angles thereto. Fixed to the extending end of the arm is an air cylinder 64, which when supplied with pressured air, serves to pivot the arm 60 through the axis 30 and across the plate opening 50. Thus, the bunches are all cut off at an equal distance from the top plate assembly 21.

In accordance with another feature of the invention means are provided for automatically feeding elastic bands to the band stretcher. As illustrated in FIGS. 4–9, there is provided a clamping mechanism for incrementally advancing the elastic tubing 22 to the band cutter 24. The tube feeder comprises a first clamping means 66 and a second clamping means 67 which interwork to advance the tube a predetermined distance on each actuation. For this purpose the tube is fed into the clamping means in the manner shown in FIG. 6, with the first clamping means including a passageway 68 through which the tube passes. The tube thereafter is threaded beneath a piston assembly 69 of the second clamping assembly. The first clamping assembly includes an air cylinder 70 actuating a piston 71 in the manner shown in FIG. 5, which piston compresses the tube against the top member 72. The first clamping means is supported on a pair of posts 74 which extend through openings 75 and are fixed to the second clamping means. Also extending between the clamping elements is an actuating shaft 76 extending from an air cylinder 77.

Figure 4:
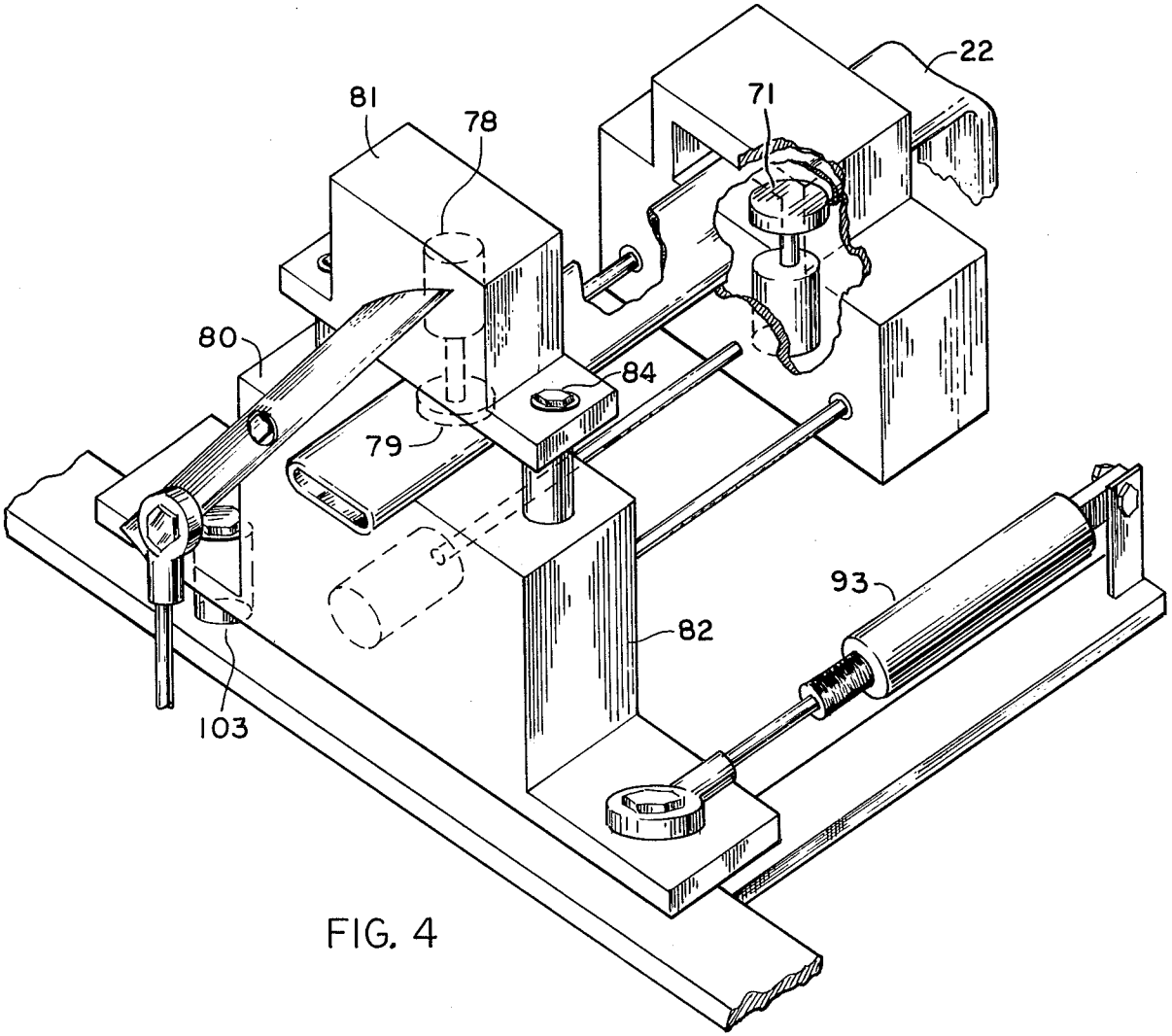
FIGS. 4, 5, and 6 are cross sectional views showing the elastic tube feeder.

After clamping the tube with the first clamping head 71 the air cylinder 77 is energized by pressured air from a source (not shown) and the first clamping means is incrementally moved towards the second clamping means by a predetermined distance, namely the stroke of the air cylinder 77. Thereafter the tube is in the position shown in FIG. 6 and a second air cylinder 78 is then energized to clamp the tube. Thus as shown in FIG. 4 with the clamping head 79 clamps the tube against the flat surface 80. The clamp housing 81 is fixed to the top of the block 82 by bolts 84.

Figure 8:
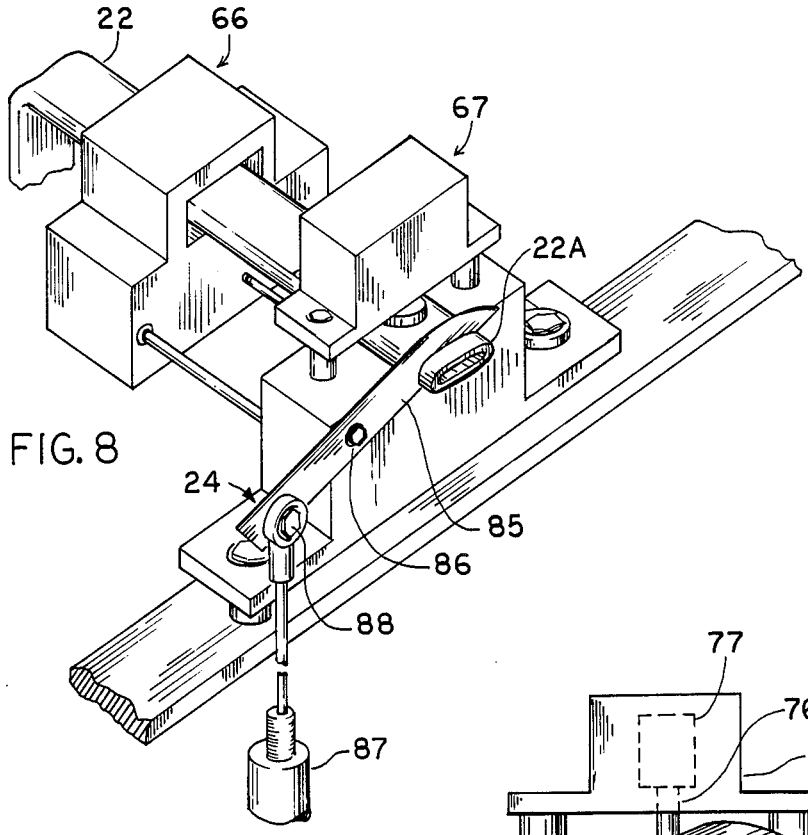
FIGS. 8 and 9 are views of the cutter for severing the elastic band from the elastic tube.
Figure 9:
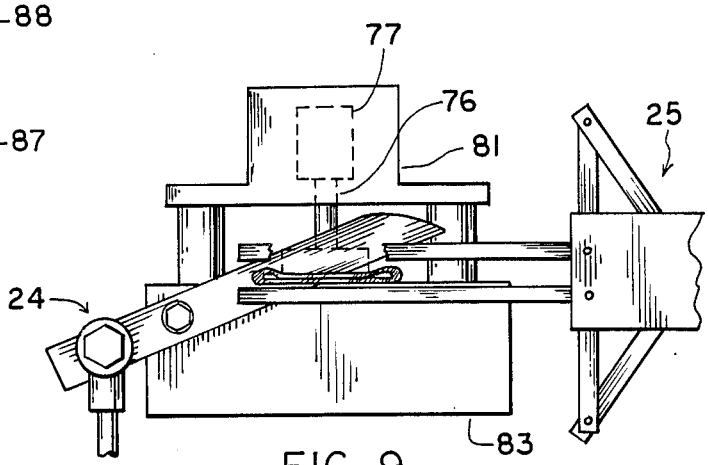
Figure 11:
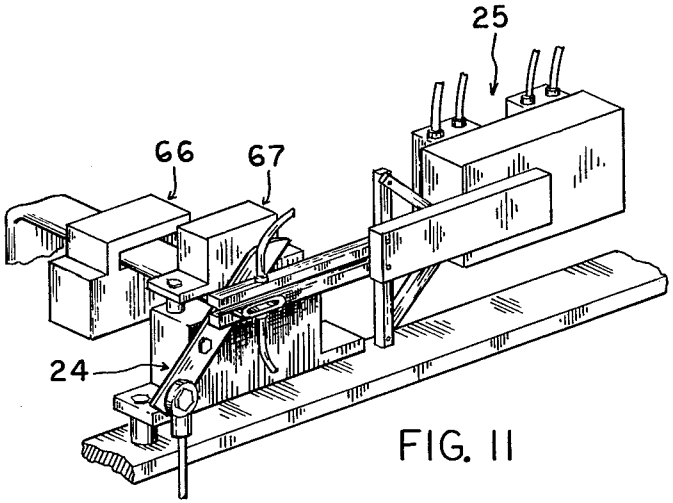
FIGS. 11 and 12 show in reduced sized the band being transferred to the band stretcher.
Figure 12:
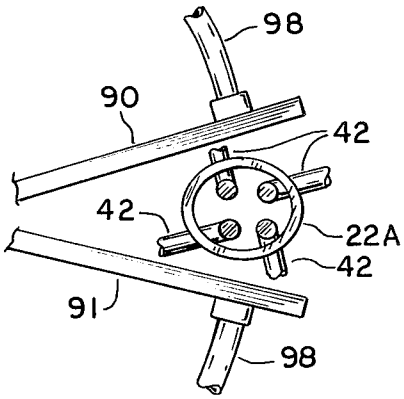

As shown in FIGS. 8 and 9 there is positioned adjacent the block 82 a cutting knife 85 pivotally supported on a bolt 86 with an air cylinder 87 attached to the non cutting end by a second bolt 88. Actuation of the air cylinder 87 by a supply of pressured air moves the knife into contact with the extending end of tube 22 and severs an elastic band 22A therefrom. Just prior to contact by the knife 85 a pair of clamping fingers (FIG. 7) 90 and 91 forming a portion of the band transfer mechanism are moved into the position shown to grasp the extending end of the tube 22. This action results from energization of an air cylinder 92 which is supplied pressured air through the air lines 94. Movement of that piston causes the rod 95 to shift lengthwise, thereby causing the lever members 96 to pivot the fingers 90 and 91 about the pivot points 97.

Simultaneously upon contact of the fingers 90 and 91 with the extending tube end a vacuum is drawn through the air conduits 98 which conduits connect with ports 99 in the respective fingers. This causes the fingers to be attached to the extending tube by the vacuum drawn within the ports 99 so as to hold the extending end of the tube tightly while the knife 85 is actuated to cut therethrough. Immediately thereafter the piston 93 is energized with pressured air to withdraw the attached shaft 93A (FIG. 4) and pivot the tube feeder just described about the bolt 103 to move the clamp housing 81 away from the clamping fingers 90 and 91 and assure that the elastic band just severed is separated from the remainder of the tube 22.

The band transfer mechanism now has been loaded with an elastic band just severed from the elastic tube and is ready to be actuated for shifting the band to the band stretcher. For this purpose the transfer mechanism 25 is supported on a shaft 100 by a lever 101 attached thereto. Attached to one end of the lever is the band holding apparatus just explained and to the other end of the lever is an air cylinder 102 having an actuating arm 104. By energization of the air cylinder 102 the shaft 104 is moved lengthwise to pivot the arm 100 about the shaft 101 and rotate the transfer mechanism away from the band cutter 24 to swing the arms 90 and 91 over the closely positioned fingers 46 of the band stretcher. Simultaneously with this movement the arms 90 and 91 are moved apart slightly so as to open the elastic band 22A in preparation for placement over the fingers of the band stretcher.

Figure 13:
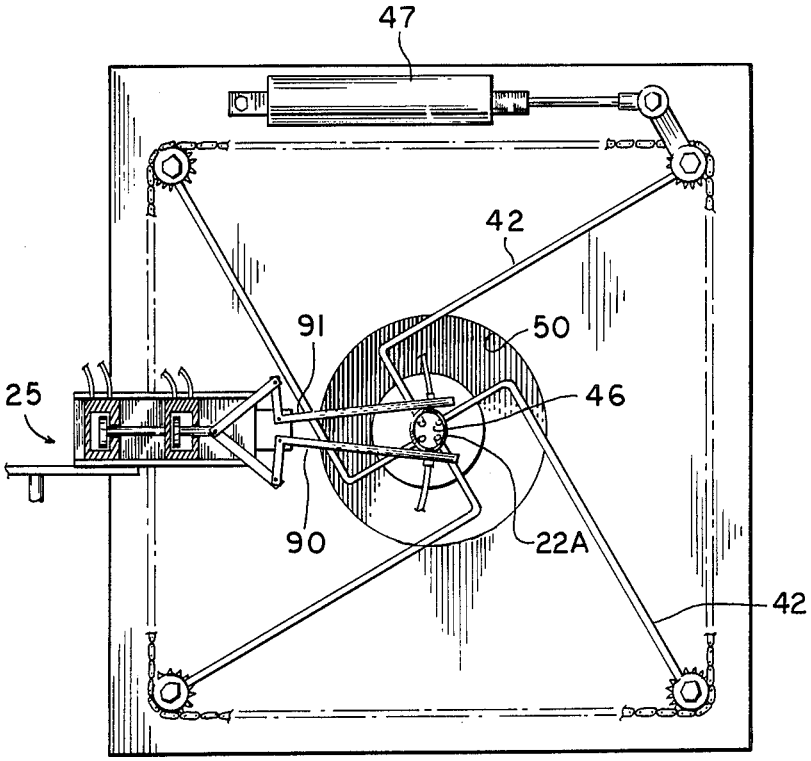
FIGS. 13 and 14 show the band placement on the band stretcher.
Figure 14:
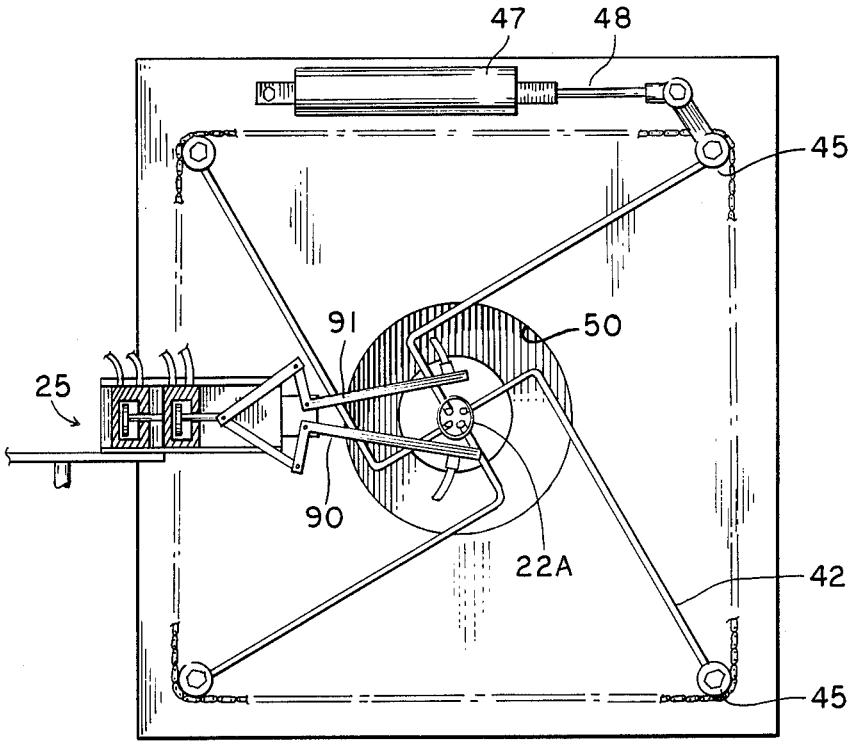

Thus as shown in FIGS. 13 and 14, the arms 90 and 91 reach a position directly over and closely adjacent to the fingers 46. The vacuum in the lines 98 is released as the arms 90 and 91 are moved further apart and the band is allowed to drop over the fingers 46 of the band stretcher. Thus, in this manner there is provided an elastic band over the band stretcher in preparation for a new banding operation. An electric eye (not shown) detects the presence of an elastic band in the stretcher and signals the control that further sequencing of the banding operation can proceed.

Figure 15:
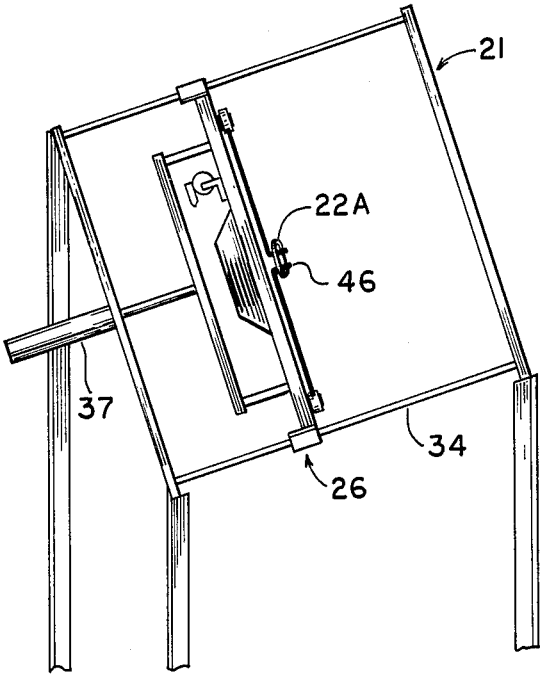
FIGS. 15, 16 and 17 show the actuation of the band stretcher.
Figure 16:
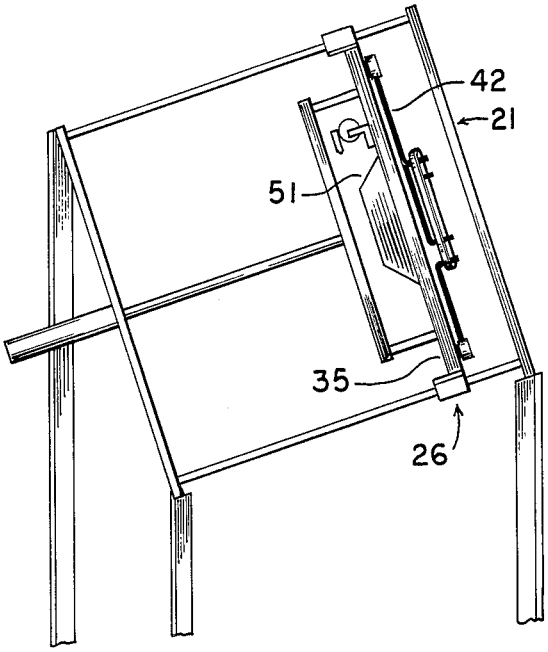
Figure 17:
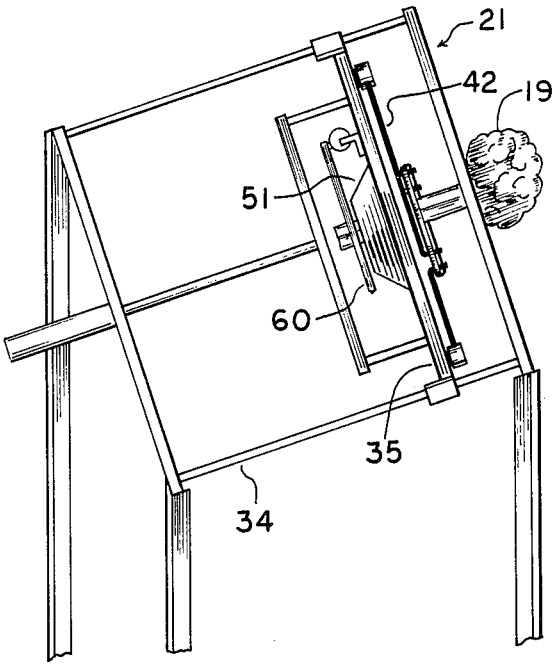
Figure 18:
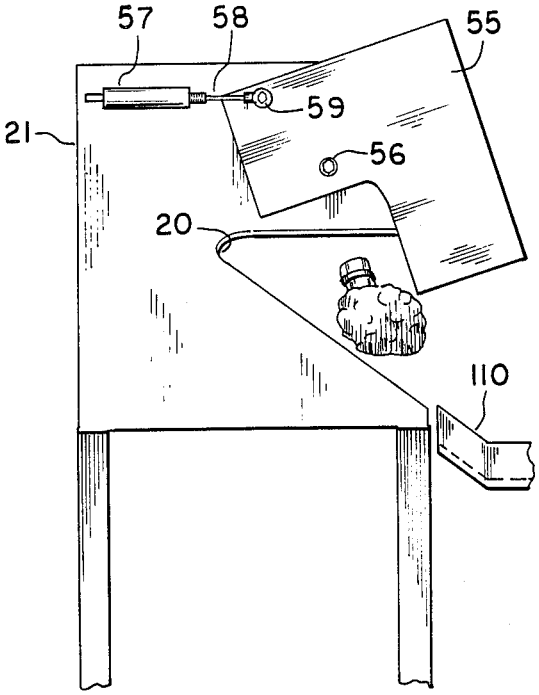
FIG. 18 shows the release of the banded bunch from the apparatus.

The band stretcher 26 is in the lower position shown in FIG. 15 with the band 22A inserted thereon. Thereafter by energization of the air actuator 37 the band stretcher is moved towards the top plate assembly 21 with the simultaneous energization of the air cylinder 47 to cause the arms 42 to stretch the band. As shown in FIG. 17 the bunch 19 can then be placed through the center opening of the top plate assembly. With relaxation of the arms 42 under the force of the elastic band the band is set about the bunch. Concurrently the knife 60 is activated to sever the bottom end from the stalks of the bunch. The air cylinder 57 is then energized to shift the top plate section 55 so as to allow the bunch to fall on a receiving chute 110. In this manner the bunch is formed, banded, cut to length, and fed to a receiving chute with the only manual operation being the placement of the bunch into the machine.

Sequencing of the functions of the apparatus just described is achieved by a control 111 comprising a drive motor 112 for driving a shaft 114 to which are attached a plurality of cams 115. These cams are rotated and each serves to actuate an associated air valve 116 to supply air from a source (not shown) to an air actuated component of the apparatus through the plurality of air tubes 117. In this manner, sequencing of the various components is achieved.

The invention claimed:

1. Apparatus for placing an elastic band around articles such as a vegetable bunch, comprising:

a band stretcher assembly including a plurality of fingers and means to actuate said fingers in opposing directions towards and away from a central axis;

a top plate assembly and top plate both being centered about said central axis to receive said vegetable bunch, means to place an elastic band over said band stretcher fingers while the fingers are actuated toward said central axis, means to actuate said fingers away from said central axis to stretch said band and allow placement of a vegetable bunch through said top plate opening and band stretcher assembly;

means to move said fingers back towards said central axis to set the elastic band around said bunch, and means to cause relative motion of said band stretcher assembly along said centeraxis and away from said top plate assembly to disengage said fingers from the elastic band and move said band stretcher assembly out of alignment with said vegetable bunch.

2. Apparatus as defined in claim 1 wherein said band stretcher includes arms moveable towards and away from said central axis with each arm including one of said fingers extending in the direction of said central axis and toward said top plate assembly.

3. Apparatus as defined in claim 1 including means to cut the bottom end from said vegetable bunch.

4. Apparatus as defined in claim 1 wherein said means to place an elastic band includes means to cut an elastic tube into elastic bands.

5. Apparatus as defined in claim 1 wherein said top plate assembly includes a top plate made of two sections pivotally attached and each bordering on said top plate opening and means to actuate one section relative to the other to enlarge said top plate opening and allow the vegetable bunch to drop therefrom.

6. The method of placing an elastic band around a vegetable bunch comprising the steps of:

providing a top plate assembly forming a first opening centered about a central axis and sized to receive said vegetable bunch, providing a band stretcher having a second opening centered about said central axis and having a plurality of fingers positioned for movement towards and away from said central axis to receive the elastic band and stretch it about said second opening, placing an elastic band over said fingers when the fingers are positioned adjacent said central axis, moving said fingers away from said central axis to stretch the elastic band, placing the bunch into said first and second openings, moving said fingers towards the central axis to relax the band about the bunch, and shifting the band stretcher along the central axis to disengage said fingers from the elastic band and move said band stretcher out of alignment with the bunch.

7. The method as defined in claim 6 including the step of cutting the bottom of the vegetable bunch after the elastic band is relaxed therearound.

8. The method as defined in claim 6 including the step of providing an elastic tube and cutting the elastic band from said tube before placing the elastic band on said fingers.

9. The method as defined in claim 6 including the step of providing a top plate in said top plate assembly made of two sections and pivotally connecting said sections so each section forms a portion of said first opening and pivoting said sections so as to enlarge said first opening after said elastic band is relaxed around said bunch and said band stretcher fingers are disengaged from the elastic band.

10. Apparatus for placing an elastic band around bunches of articles comprising, banding means to receive an elastic band and stretch it to receive an article bunch, and a plate assembly forming an opening to guide said article bunch into said banding means, comprising:

a plate formed of two sections hinged together and forming a center opening with each section bordering on said opening such that by hinging said sections apart said article bunch is allowed to fall from said top plate assembly.

11. Apparatus as defined in claim 10 including means to move said plate sections to reduce the size of said center opening to better support said article bunch.

* * * * *